US007549407B2

(12) United States Patent
Krupadanam

(10) Patent No.: US 7,549,407 B2
(45) Date of Patent: Jun. 23, 2009

(54) METHOD AND SYSTEM FOR CONTROLLING A VALVE DEVICE

(75) Inventor: Ashish S. Krupadanam, Rochester Hills, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 273 days.

(21) Appl. No.: 11/692,389

(22) Filed: Mar. 28, 2007

(65) Prior Publication Data

US 2008/0237517 A1 Oct. 2, 2008

(51) Int. Cl.
*F02D 41/14* (2006.01)

(52) U.S. Cl. ..... 123/399; 123/361

(58) Field of Classification Search ..... 123/399, 123/361; 701/93, 96
See application file for complete search history.

(56) References Cited

U.S. PATENT DOCUMENTS

| | | | | |
|---|---|---|---|---|
| 4,486,797 | A | 12/1984 | Workman | |
| 4,575,776 | A | 3/1986 | Stephens et al. | |
| 4,616,276 | A | 10/1986 | Workman | |
| 4,679,103 | A | 7/1987 | Workman et al. | |
| 4,835,633 | A | 5/1989 | Edel et al. | |
| 5,162,998 | A * | 11/1992 | Kondo | 701/93 |
| 6,175,799 | B1 * | 1/2001 | Tsutsumi et al. | 701/96 |
| 6,523,522 | B1 | 2/2003 | Costin | |
| 6,536,407 | B1 | 3/2003 | Denbratt | |
| 6,662,760 | B1 | 12/2003 | Stanglmaier et al. | |
| 6,662,785 | B1 | 12/2003 | Sloane et al. | |
| 6,876,168 | B1 | 4/2005 | Luo et al. | |
| 2006/0201481 | A1 | 9/2006 | Reitz et al. | |

FOREIGN PATENT DOCUMENTS

| | | | |
|---|---|---|---|
| DE | 42 003 191 | A1 * | 8/1993 |
| JP | 62-106431 | A * | 5/1987 |
| JP | 4-194644 | A * | 7/1992 |
| JP | 2000-352342 | A * | 12/2000 |

* cited by examiner

*Primary Examiner*—Hieu T Vo

(57) ABSTRACT

A system and method are disclosed for controlling the positioning of a movable member of a valve device by an electric actuator. A model is used to generate estimates for the position and velocity of the movable valve member that result from an actuator control signal being applied to drive the electric actuator. The actuator control signal comprises a feedback control signal combined with a feedforward control signal. The feedback control signal is generated based upon a difference between the estimated and actual positions of the movable valve member, while the feedforward control signal is generated based upon the desired position, the estimated position, and the estimated velocity. The feedforward signal is adjusted to cause the estimated velocity to approximately follow a defined maximum deceleration velocity trajectory as the estimated position of the movable valve member moves to the desired position. An exemplary embodiment is presented where the principles of the invention are applied to the control of an electronic throttle valve.

21 Claims, 7 Drawing Sheets

METHOD AND SYSTEM FOR CONTROLLING A VALVE DEVICE

TECHNICAL FIELD

The present invention relates to a method and apparatus for controlling a valve device having a movable valve member positioned by an electric actuator, and more particularly, to a method and apparatus for improved control of valve devices such as electronic throttle valves and the like.

BACKGROUND OF THE INVENTION

Over the past several years, different control techniques have been employed for the positioning of movable valve members of valve devices utilizing electric motors. Generally, the speed and accuracy at which such valve members can be positioned is of significance. One such application where the speed and accuracy of positioning the movable valve member provides important functional advantages is in the area of electronic throttle control (ETC).

Modern vehicles generally employ some type of electronic throttle control (ETC) system for positioning of the engine intake air throttle valve to achieve the benefits of reduced emissions, increased fuel economy, and improved vehicle drivability. Such systems employ an electronic throttle valve having an electric actuator, such as a brushless DC electric motor, which is coupled to movable throttle plate within the bore of the electronic throttle, thereby forming a butterfly valve for adjusting the amount of air flowing into the engine. Fast and accurate positioning of the throttle plate is required in order to take full advantage of the above described benefits. Additionally, the positioning of the throttle plate in response a desired change of the throttle valve position needs to be aperiodic with minimal transient ripples during settling to avoid excessive system component wear, and increased motor losses.

Most vehicles employing ETC provide a so called limp home mode of operation in the event of an ETC failure. This is typically accomplished by employing opposing springs in the electronic throttle valve for biasing the throttle plate to a predetermined open position, if the electric motor is not energized due to a malfunction. This allows the engine to operate in a high idle condition to permit slow movement of the vehicle with continued operation of the power brakes, power steering, and electrical system. Use of the biasing springs in the electronic throttle valve generally introduces significant nonlinear spring forces, which along with other frictional forces can complicate the positioning of the throttle plate.

In the past, ETC systems have used Proportional-Integral-Derivative (PID) controllers with nonlinear feedback and/or feedforward compensation to account for the frictional forces and nonlinearities of the opposing dual biasing springs (see for example, U.S. Pat. No. 6,523,522, which is assigned to the same assignee as the present invention, and is hereby incorporated by reference). With such ETC systems, the PID gain is usually tuned to provide a motor control signal for the electric motor that achieves the fastest possible end-position to end-position throttle response (closed to open or open to closed throttle plate positions) without saturating the motor control voltage, which is typically bounded by defined voltage limits (typically +12 volts and −12 volts for automotive applications utilizing 12 volt batteries).

As indicated above, the throttle response needs to be aperiodic, without large settling transient ripples when repositioning the throttle plate. This generally requires that the electric motor in an ETC system have a relatively large torque constant and large motor drive currents. Due to these constraints, controllers in ETC systems rarely use the maximum available motor control voltages when generating motor control signals for controlling the electric motors. As a consequence, the response time required for positioning of the throttle valve in such ETC systems tends to be appreciably less than optimal.

Accordingly, there exists a need for a method and apparatus for controlling motor actuated valve devices such as electronic throttle valves, wherein a significantly larger portion of the available actuator control voltage can be utilized when positioning the movable valve members of such valve devices to achieve more optimal control.

SUMMARY OF THE INVENTION

The present invention provides an improved method and system for controlling valve devices having movable members positioned by electric actuators. The improvement is accomplished by utilizing a significant portion of the available actuator control voltage when controlling the valve device.

In accordance with the invention, a desired position signal indicative of the desired position of the movable valve member, and an actual position signal indicative of the actual position of the movable valve member are obtained. A feedforward control signal is generated based upon the desired position signal, a simulated position signal, and a simulated velocity signal. A feedback control signal is generated based upon a difference between the estimated position signal and the actual position signal. The feedforward and feedback control signals are combined to produce an actuator control signal that is applied to drive the electric actuator to control the movement of the movable valve member from the actual position to the desired position.

The simulated position signal and simulated velocity signal respectively represent an estimated position and velocity for the movable valve member that would result from a simulated actuator control signal comprising the feedforward signal being applied to drive the electric actuator. The simulated position and simulated velocity signals are generated in response to the simulated actuator control signal being applied to a mathematical model representing electromechanical functions performed by the valve device and electric actuator.

The feedforward control signal is characterized by a voltage that is adjusted to cause the estimated velocity of the movable valve member to approximately follow a defined maximum deceleration velocity trajectory as the estimated position moves to the desired position. Preferably, the voltage of the feedforward signal comprises a predetermined maximum voltage, which is adjusted in accordance with a defined saturation function that varies based upon the desired position signal, the simulated position signal, and the simulated velocity signal. The predetermined maximum voltage for the feedforward control signal is selected to utilize a substantial portion of available actuator control voltage to enhance the acceleration and deceleration of the throttle plate in controlling the estimated velocity without causing saturation of the motor control signal.

Accordingly, the invention provides for more optimal use of available actuator control voltage when controlling valve devices, which significantly reduces the response time of such valve devices, without introducing additional overshoot and settling time.

According to another aspect of the invention, a compensation signal is generated based upon the actual position signal, and a simulated compensation signal is generated based upon the simulated position signal. The compensation signal is then combined with the feedback control signal to produce the actuator control signal, and the simulated compensation signal is combined with the feedforward control signal to produce the simulated actuator control signal. In this way, the actuator control signal and simulated actuator control signal can be compensated to offset torque opposing movement of the movable valve member caused by frictional and/or spring biasing forces associated with the valve device and electric actuator.

An exemplary embodiment is provided, wherein the principles of the present invention are applied to improve the control of an electronic throttle valve.

BRIEF DESCRIPTION OF THE DRAWINGS

The present invention will now be described in the following detailed description with reference to the accompanying drawings. Like reference characters designate like or similar elements throughout the drawings in which.

DESCRIPTION OF THE PREFERRED EMBODIMENT

Figure 1:
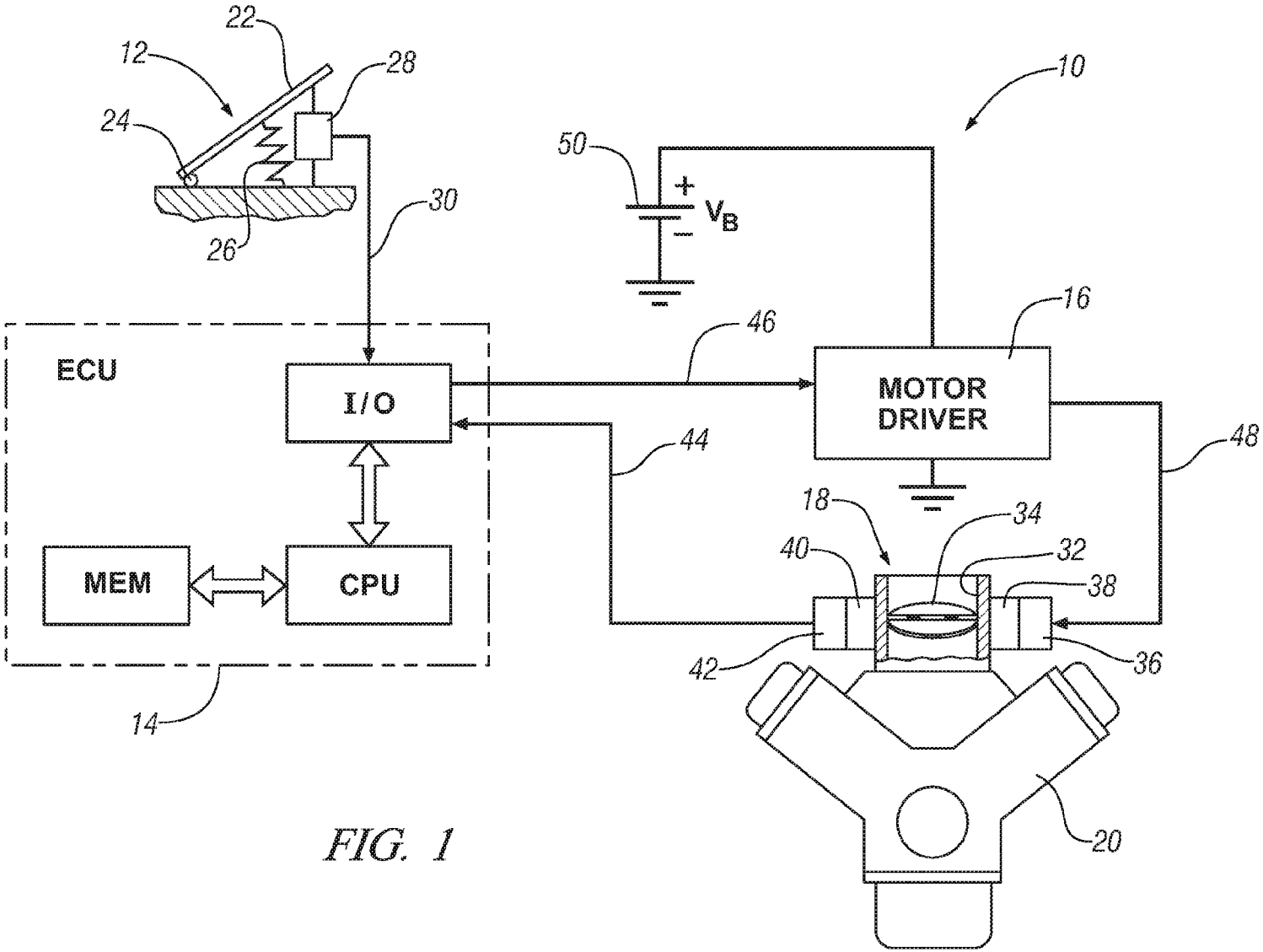
FIG. 1 is a schematic diagram of an engine control system in which the invention may be implemented.

Referring now to FIG. 1, there is shown an exemplary engine control system generally designated by the numeral 10, in which the present invention may be implemented for an electronic throttle control (ETC) application. The basic components for the ETC in engine control system 10 include an accelerator pedal assembly generally designated as 12, a control unit designated here as engine control unit (ECU) 14, a motor driver 16, and an electronic throttle valve generally designated as 18 for adjusting the amount of air flowing into an engine 20. Those skilled in the art will recognize that engine control system 10 generally will include additional components that have not been shown that are typically present for controlling operational aspects of engine 20 other than ETC . The control unit 14 may also be referred to as an engine control module (ECM) or a powertrain control module (PCM) depending upon the functionality integrated into the control unit 14.

Accelerator pedal assembly 12 includes an accelerator pedal 22, which is depressed in accordance with the amount of output power desired to be produced by engine 20. As shown, accelerator pedal 22 rotates about pivot point 24, and is biased by pedal spring mechanism 26 to return to a position corresponding to engine idle in the absence of force applied to pedal 22. A pedal position sensor 28, such as a sliding potentiometer, is typically used to measure the amount of depression of pedal 22, and to provide a pedal position signal, which is communicated to and received by ECU 14 as shown by arrowed line 30.

Although not shown, those skilled in the art will recognize that in practice, pedal position sensor 28 will typically employ multiple potentiometers for sensing the depression of pedal 22 so as to provide ECU 14 with redundant pedal position signals. These redundant pedal position signals may be used in the event of a potentiometer failure, and for performing diagnostic testing of the accelerator pedal assembly 12.

Although alternative arrangements are possible, FIG. 1 shows engine control system 10 as having a control unit ECU 14, which includes a central processing unit (CPU) typically provided by a microprocessor, a memory (MEM), and an input/output interface (I/O). Control unit ECU 14 will also include other known circuitry necessary for controlling the operation of engine 20 that has not been specifically shown in FIG. 1.

It will be understood that in performing control operations, the CPU of engine control unit 14 executes programs stored in memory MEM to generate engine control signals output by the I/O based upon measured engine operating signals communicated as input to the I/O.

The electronic throttle valve 18 comprises an intake air bore 32 in which a throttle plate 34 is pivotally mounted, thereby forming a butterfly or throttle valve for adjusting of air flowing into engine 20. Electric actuator 36 is mechanically coupled by way of a gear mechanism 38 to rotate throttle plate 34 within the intake air bore 32. In this application, an electric motor such as a brushless DC servo motor is used as the electric actuator 36, but any other type of known electric actuator capable of appropriately positioning throttle plate 34 could be used.

When electric motor 36 is appropriately energized, the rotor (not shown) drives gear mechanism 38 to rotate throttle plate 34 in either a clockwise or counter-clockwise direction, thereby adjusting the degree of opening of the throttle plate 34 within intake air bore 32. Electronic throttle valve 18 also typically includes a throttle spring mechanism 40 for biasing throttle plate 34 to a predetermined position corresponding to high engine idle, when electric motor 36 is not energized (see the previous discussion related to the limp home operating mode).

Throttle plate 34 is also coupled to a throttle position sensor 42, which may be implemented by way of a sliding potentiometer for sensing the rotational position of throttle plate 34, and providing a corresponding actual position signal for throttle plate 34, which is received by ECU 14 as indicated by arrowed line 44. Accordingly, the actual position signal provides ECU 14 with an indication of the actual position of the throttle plate 34 within intake air bore 32.

Although not shown, those skilled in the art will recognize that in practice, throttle position sensor 42 will also typically employ multiple potentiometers for sensing the rotational position of throttle plate 34 to provide ECU 14 with redundant throttle position signals. These redundant throttle position signals are used in the event of a potentiometer failure, and for performing diagnostic testing of the electronic throttle valve 18.

For simplicity, electronic throttle valve 18 has been shown schematically in FIG. 1. The mechanical implementation of such electronic throttle valve assemblies is well known in the art (see for example, the previously referenced U.S. Pat. No. 6,523,522). Accordingly, further structural details of the electronic throttle valve 18 will not be discussed in the present specification.

In controlling the positioning of throttle plate 34, the CPU of ECU 14 executes a throttle control software program stored in MEM to generate an appropriate motor control signal for controlling the operation of electric motor 36. This motor control signal is transformed into motor driver input signals that are communicated from the I/O of ECU 14 to the motor driver 16 as indicated by arrowed line 46. As will subsequently be described, signals indicating the positions of the accelerator pedal 22, and the throttle plate 34 of the electronic throttle valve 18 are utilized by a stored throttle control software program in generating the appropriate motor control signal and corresponding motor driver input signals.

Motor driver 16 generally comprises a conventional H-bridge with suitable switching circuitry known to those skilled in the art. With regard to packaging, the motor driver circuitry could be included within ECU 14 or even within electronic throttle valve 18. Based upon the motor driver input signals provided by ECU 14, motor driver 16 appropriately applies the power supply voltage $V_B$ provided by battery 50 to the stator field windings (not shown) of electric motor 36, as indicated by arrowed line 48. In this way, ECU 14 then controls the operation of electric motor 36 and the position or degree of opening of the throttle plate 34 in electronic throttle valve 18.

The motor driver input signals generally comprise a pulse width modulated (PWM) signal having a duty cycle representing the average voltage to be applied to the field windings of electric motor 36, and a motor directional rotation signal representing the polarity of the average voltage applied to the field windings. Based upon these motor driver input signals, it will be understood that the average voltage applied across the stator field windings of electric motor 36 can then be varied between the voltage limits of $+V_B$ to $-V_B$, which are defined as the voltage limits for the motor control signal (typically +12 volts and −12 volts in automotive applications).

In the discussion that follows, reference will be made to a motor control signal having a voltage that varies between the motor control voltage limits of $+V_B$ to $-V_B$. This motor control signal will be understood to correspond or be equivalent to the motor driver input signals applied to motor driver 16. When the motor control signal has a positive amplitude, electric motor 36 is driven in a direction to open the throttle plate 34. When the motor control signal has a negative amplitude, electric motor 36 is driven in a direction to close throttle plate 34. The magnitude of the motor control signal then represents the average voltage applied to the stator field windings of electric motor 36 by way of the PWM motor driver signal applied to motor driver 16 by ECU 14. It will also be understood that direction and magnitude of motor drive currents generated in the stator field windings of electric motor 36 are then also determined by the polarity and magnitude of the voltage of the motor control signal.

Figure 2A:
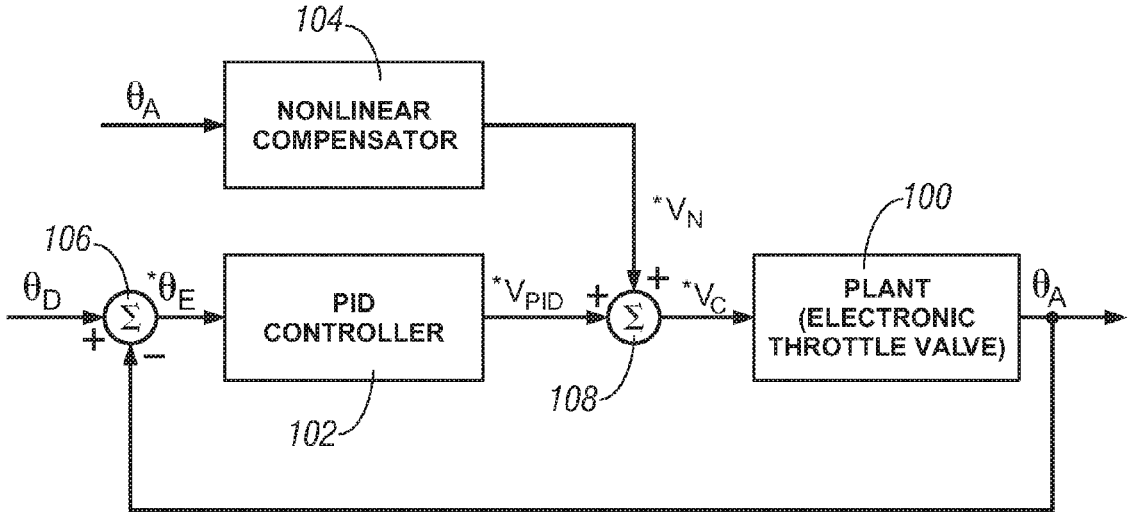
PRIOR ART FIG. 2A
FIG. 2A is a functional block diagram depicting a prior art electronic throttle control (ETC) system utilizing a conventional PID feedback controller with a nonlinear compensator for offsetting frictional and/or spring biasing forces associated with the electronic throttle valve.

Referring now to FIG. 2A, there is shown a functional block diagram of a prior art ETC system that employs conventional feedback control for positioning the throttle plate 34 of the electronic throttle valve 18 depicted in FIG. 1. This functional diagram includes a plant 100 comprising components of electronic throttle valve 18, a traditional PID controller 102 providing for the feedback control of plant 100, a nonlinear compensator 104 for offsetting torque caused by frictional and/or spring biasing forces (typically nonlinear) that are associated with plant 100 (i.e., electronic throttle valve 18), and summing junctions 106 and 108 that are used to appropriately combine signals in accordance with the indicated sign adjacent to signal inputs.

The signal $\theta_A$ (the actual position signal) represents the actual or measured rotational position of throttle plate 34 in electronic throttle valve 18, while the signal $\theta_D$ (the desired position signal) represents a target or desired rotational position for throttle plate 34. The actual position signal $\theta_A$ is determined based the input obtained by the ECU 14 on arrowed line 44 from throttle position sensor 42. Generally, the desired position signal $\theta_D$ is determined based upon the amount of depression of the accelerator pedal 22 based upon the input obtained by ECU 14 on arrowed line 30 from pedal position sensor 28. To simplify the structure shown in FIG. 1, other input signals to ECU 14 that may also be used in determining or influencing the desired position signal $\theta_D$ for throttle plate 34 have not been shown. These other input signals could, for example, be provided by traction control, idle control, cruise control, and/or other engine control systems that may be active depending upon the operating mode of engine 20.

In operation, the prior art ETC control system functions to generate a motor control signal $*V_C$, which is shown as being applied to the plant 100 representing the electronic throttle valve 18. Any distortions caused by the transformation of the motor control signal $*V_C$ into the appropriate motor driver input signals, and the action of the motor driver 16 in energizing electric motor 36 are generally not significant, and are typically ignored when representing ETC systems in a functional block diagram form such as shown in FIG. 2A. As previously described, the polarity and amplitude of motor control signal $*V_C$ determines the polarity and average voltage applied to the stator field windings of electric motor 36 in adjusting the position of throttle plate 34.

As shown, the motor control signal $*V_C$ comprises the sum of two composite control signals $*V_N$ and $*V_{PID}$, which are combined by summing junction 108. In this case, $*V_{PID}$ is a feedback control signal generated by the PID controller 102 based upon an input throttle position error signal $*\theta_E$, while $*V_N$ is a compensation control signal generated by nonlinear compensator 104 based upon the actual position signal $\theta_A$ for throttle plate 34.

The above throttle position error signal $*\theta_E$ is output by summing junction 106 and is determined by subtracting the actual position signal $\theta_A$ from the desired position signal $\theta_D$ to form a difference represented by $*\theta_E$ (i.e., $*\theta_E=\theta_D-\theta_A$). In the conventional ETC system, PD controller 102 is tuned to generate feedback control signal $*V_{PID}$ so that throttle plate 34 is moved from the actual to the desired position by reducing the difference represented by throttle position error signal $*\theta_E$ to zero in response to $*V_{PID}$ being applied to drive the electric motor 36 in plant 100.

Different types of nonlinear compensators have been used in the prior art for offsetting torque effects due to frictional and/or spring biasing forces (typically nonlinear) associated with the controlled mechanisms within plant 100. For the prior art ETC implementation shown in FIG. 2A, the nonlinear compensator 104 generates the compensation control signal $*V_N$ based upon the actual position of throttle plate 34 as communicated by the actual position signal $\theta_A$.

Figure 2B:
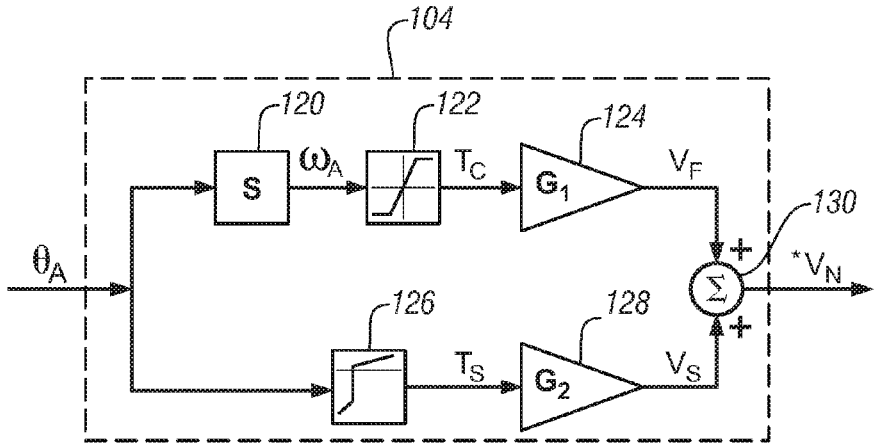
PRIOR ART FIG. 2B
FIG. 2B is a functional block diagram depicting the operations carried out by the nonlinear compensator shown in FIG. 2A.

FIG. 2B provides a detailed functional block diagram showing the operations carried out by the exemplary nonlinear compensator 104 depicted in FIG. 2A. This embodiment of nonlinear compensator 104 has two separate operational paths for carrying out different parallel operations on the actual position signal $\theta_A$ for throttle plate 34.

In one of the operational paths, the actual position signal $\theta_A$ is first differentiated by block 120 (where s denotes the Laplace operator) to provide the signal $\omega_A$, which represents the actual rotational angular velocity of throttle plate 34. This actual velocity signal $\omega_A$ is applied to a lookup table represented by block 122, which provides an output signal $T_C$ representing the frictional torque opposing the movement of throttle plate 34. In this implementation, the lookup table in block 122 is essentially a sgn function such that $T_C=F_C\text{sgn}(\omega_A)$, where the constant $F_C$ is associated with coulomb frictional forces acting against the movement of throttle plate 34. The frictional torque signal $T_C$ is then passed to block 124, which represents an inverse voltage to torque transfer function for electric motor 36 associated with frictional torque. Since electric motor 36 has a bandwidth much larger than the frequency components of significance in the frictional torque signal $T_C$, the inverse voltage to torque transfer function of block 124 can be simply represented by an empirically determined gain or scaling multiplier $G_1$. With the appropriate selection of the value of $G_1$, the output signal $V_F$ from block 124 then represents a control signal that can be applied to the input of plant 100 to approximately offset coulomb frictional torque opposing the movement of throttle plate 34 in electronic throttle valve 18.

In the other operational path of nonlinear compensator 104, the actual position signal $\theta_A$ is applied to a lookup table represented by block 126, which provides an output signal $T_S$. The output signal $T_S$ represents the spring biasing torque opposing the movement of throttle plate 34. In this implementation the lookup table represents a piecewise linear approximation to the nonlinear spring biasing torque produced by throttle spring mechanism 40, which varies as a function of the actual position of throttle plate 34 provided by signal $\theta_A$. The spring biasing torque signal $T_S$ is then passed through block 128, which represents the inverse voltage to torque transfer function of electric motor 36 for the spring biasing torque. Again, since electric motor 36 has a bandwidth much larger than the frequency components of significance in the spring biasing torque signal $T_S$, the inverse voltage to torque transfer function of block 128 can be simply represented by an empirically determined gain or scaling multiplier $G_2$. With the appropriate selection of the value for $G_2$, the output signal $V_S$ from block 128 then represents a control signal that can be applied to the input of plant 100 to offset spring biasing forces opposing the movement of throttle plate 34.

The control signals $V_F$ and $V_S$ are combined or added together by summing junction 130 to provide the final compensation control signal $*V_N$, which is output by nonlinear compensator 104.

In some instances the spring biasing mechanism 40 may not be present in the particular valve device being controlled, the frictional forces may not be significant, or such forces might be intentionally ignored for simplicity. In these cases, the nonlinear compensator 104 would not be required in the functional control structure depicted in FIG. 2A.

In other applications, nonlinear compensator 104 could be implemented to compensate for only frictional forces (as provide here by $V_F$) or only spring biasing forces (as provided here by $V_S$), depending upon the significance of these forces and the performance of the compensation techniques. Those skilled in the art will understand that other known nonlinear compensation techniques can be used to implement different functional structures for nonlinear compensator 104.

Figure 3A:
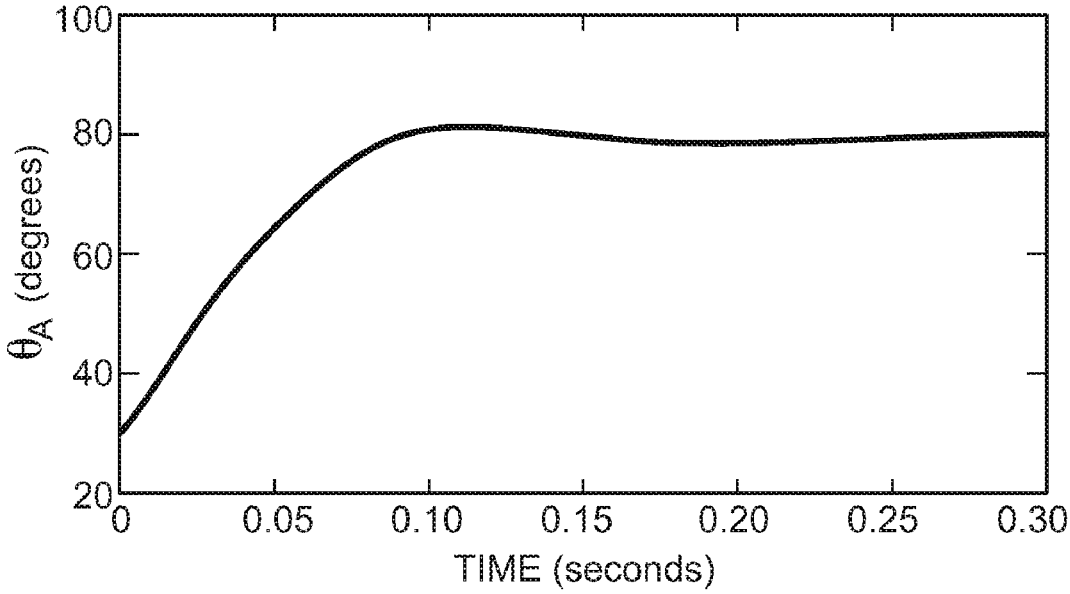
PRIOR ART FIG. 3A
FIGS. 3A-3B respectively show simulated graphical representations of the throttle valve response and motor control signal that result from a step change in desired throttle position in the prior art ETC system depicted in FIG. 2A.
Figure 3B:
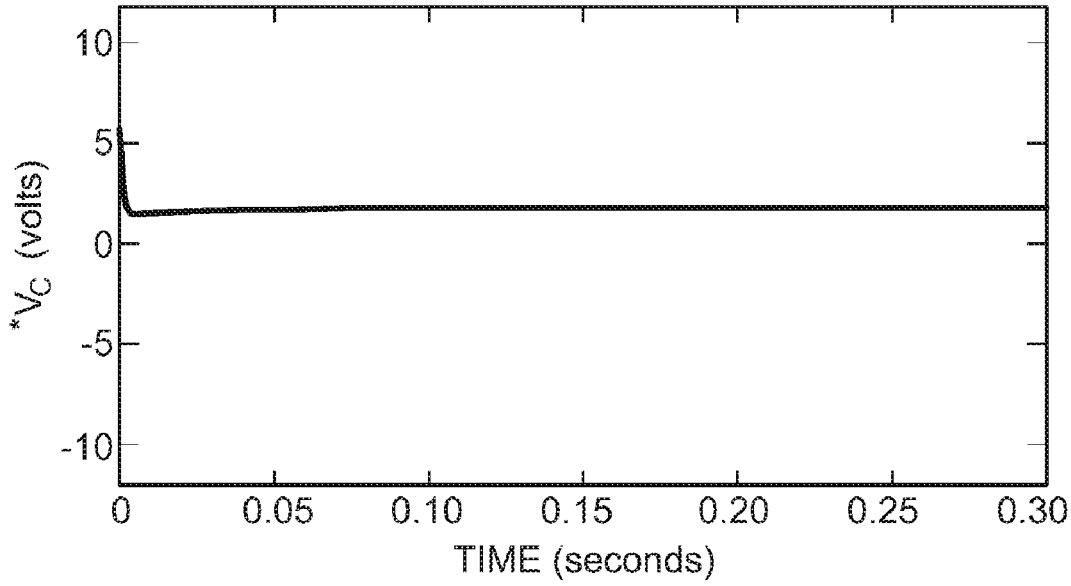
PRIOR ART FIG. 3B

FIGS. 3A and 3B respectively show simulated graphical representations of the response of the throttle valve (also referred to as the throttle response) in terms of actual position signal $\theta_A$, and the motor control signal $*V_C$ resulting from a step function increase in the desired throttle position $\theta_D$ for the prior art ETC system of FIG. 2A. The graphical results were obtained using commercially available MATLAB® simulation software.

The throttle response of FIG. 3A is shown as the change in the actual position signal $\theta_A$ for throttle plate 34 as a function of time for a step function increase in the opening of throttle plate 34 from the desired position of $\theta_D$=30° to a desired position $\theta_D$=80° that occurs at time=0 seconds. The corresponding motor control signal $*V_C$ is shown in FIG. 3B as a function of time for the same step increase in the desired position for throttle plate 34.

It will be recognized from FIG. 3B that motor control signal $*V_C$ has an initial contribution due to the feedback control signal $*V_{PID}$ that quickly approaches zero, followed by the contribution of the compensation signal $*V_N$ that provides an offset voltage of approximately 2.0 volts to maintain the spring biased throttle plate 34 at the desired open position. For later reference, it will be understood from FIG. 3A that the rise time of the throttle response of throttle plate 34 to reach the desired 80° open position is approximately 60.6 milliseconds when responding to the above described step increase in desired throttle position.

The prior art ETC systems generally utilizes only a relatively small portion of the available motor control voltage ($-V_B$ to $+V_B$) because the gains of the PID controllers must be tuned to avoid saturation of the motor control signal for the largest expected changes in the throttle position error signal $*\theta_E$, and to satisfy other constraints on the throttle response when positioning throttle plate 34. As a consequence, these prior art ETC systems are suboptimal with regard to the time required for repositioning of the throttle plate 34 from an actual to a desired position.

A technique known as proximate time optimal servomechanism control (PTOS control) has been used in the past for controlling the positioning of disk drives. Basically a PTOS controller switches from a bang-bang controller to a linear proportional derivative (PD) controller when the head position error (i.e., the difference between the desired head position and the actual measured head position) is less than a predefined threshold value. PTOS is known to improve the response time for positioning the head of a disk drive over a desired track for reading and writing data.

The applicant has found that certain concepts of PTOS control can be applied in a novel manner to achieve significant improvements in the positioning response times of valve devices having movable valve members positioned by electric actuators, as for example, the throttle plates of electronic throttle valves. In particular, the applicant has found that by providing an actuator control signal with a feedforward modified bang-bang type signal component, a relatively larger portion of the available actuator control voltage can be utilized to control the positioning of the movable valve member. Accordingly, the response of the valve device can be improved, as compared to convention PID control techniques, without introducing significant response overshoot or settling time. The implementation of this type of control with regard to the present invention will be referred to herein as proximate time optimal control (or PTO control).

In what follows, the present invention will be described by way of an exemplary embodiment where the valve device is the previously described electronic throttle valve 18 having throttle plate 34 as the movable valve member positioned by electric motor 36 acting as the electric actuator. It will be understood that the present invention is not limited to this particular application, and can be used to control any valve device having a movable member position by an electric actuator.

In the embodiment that follows, any reference to the position of throttle plate 34 will mean the angular rotational position of throttle plate 34 within the bore 32, and any reference to the velocity of the throttle plate or throttle valve will mean the rotational angular velocity of throttle plate 34 within bore 32.

Figure 4:
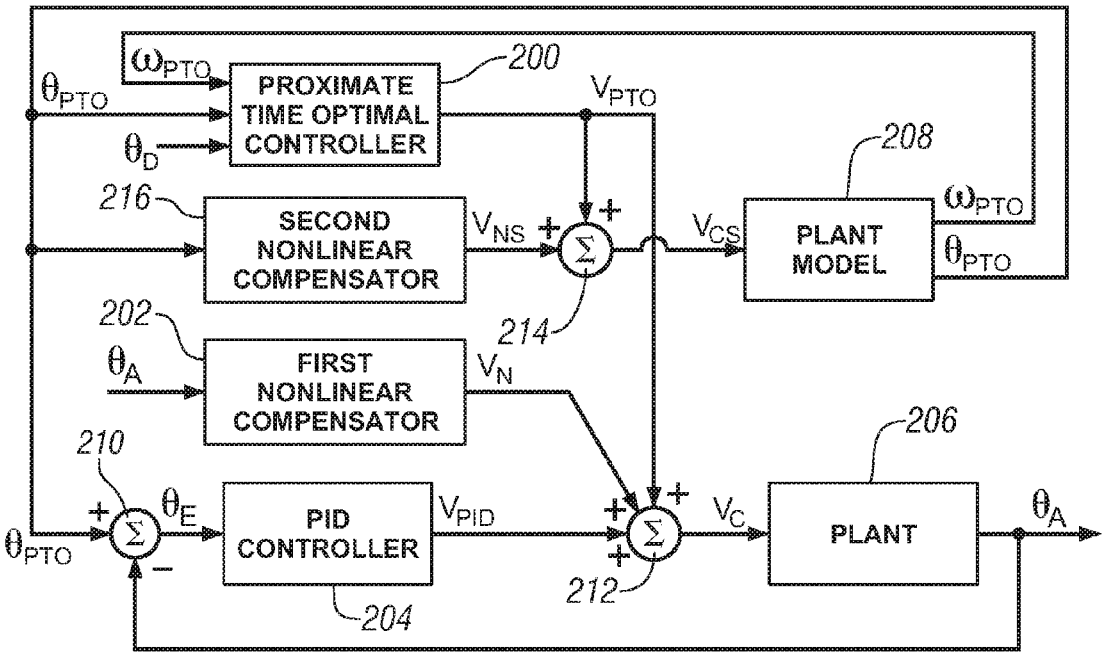
FIG. 4. is a functional block diagram for an exemplary embodiment of the present invention.

Referring now to FIG. 4, there is shown a functional block diagram for an exemplary implementation of the present invention. The function block diagram comprises a proximate time optimal controller 200, a first nonlinear compensator 202, a second nonlinear compensator 216, a PID controller 204, a plant 206, a plant model 208, and summing junctions 210, 212, and 214.

Plant 206 represents the controlled valve device, which includes a movable valve member positioned by an electric actuator. In this embodiment, the actuator control signal $V_C$ represents the motor control signal, which is applied to the plant 206 for positioning throttle plate 34. The actual position signal $\theta_A$ represents the actual position of the movable valve member, which in this case is throttle plate 34.

Plant model 208 represents a mathematical model representing electromechanical functions performed by the actual physical components of the valve device and electric actuator in plant 206. The plant model 208 generates a simulated position signal $\theta_{PTO}$, and a simulated velocity signal $\omega_{PTO}$, which respectively represent an estimated position and an estimated velocity for the movable valve member that results when a simulated actuator control signal $V_{CS}$ is applied to drive the electric actuator being modeled in plant 208. A more detailed description of plant model 208 is provided below in the discussion associated with FIG. 5.

The first nonlinear compensator 202 operates in a similar fashion as the previously described nonlinear compensator 104 of FIG. 2A in generating an output compensation control signal designated as $V_N$ based upon the input actual position signal $\theta_A$. In the preferred embodiment, the first nonlinear compensator 202 utilizes only that portion of the compensator 104 of FIG. 2B that compensates for the nonlinear spring biasing torque (i.e., $V_N=V_S$). The output compensation control signal $V_N$ is provided as an input to summing junction 212.

The second nonlinear compensator 216 also operates in the same fashion as the previously described nonlinear compensator 104 of FIG. 2A in generating an output simulated compensation control signal designated as $V_{NS}$ based upon the input simulated position signal $\theta_{PTO}$. Again, for the preferred embodiment, the second nonlinear compensator 216 utilizes only that portion of the compensator 104 of FIG. 2B that compensates for the nonlinear spring biasing torque (i.e., $V_{NS}=V_S$). This simulated compensation control signal $V_{NS}$ is directed as an input to summing junction 214, where it is combined with a feedforward control signal (the proximate time optimal control signal) $V_{PTO}$ to provide the simulated actuator control signal $V_{CS}$ (i.e., $V_{CS}=V_{PTO}+V_{NS}$).

The first nonlinear compensator 202 in this exemplary embodiment of the invention is a feedback type compensator because it uses the actual position signal $\theta_A$ in determining the compensation control signal $V_N$. The second nonlinear compensator 216 is a feedforward type compensator because it does not use the actual position signal $\theta_A$ for determining the simulated compensation control signal $V_{NS}$, but instead uses the simulated position signal $\theta_{PTO}$. It will be understood that other known types of nonlinear compensation techniques may be used in implementing the first and second nonlinear compensators 202 and 216.

Although it is not absolutely necessary, better performance will be achieved if both the first and second nonlinear compensators 202 and 216 perform the same functions when generating the compensation control signal $V_N$ and the simulated compensation control signal $V_{NS}$. Additionally, the present invention can be implemented without compensation for any opposing torque forces within plant 206 and plant model 208; however, this may degrade control performance depending upon the significance of the opposing torque forces. An embodiment of the invention without such compensation would be implemented by removing both the first and second nonlinear compensators 202 and 216, and the contribution of their respective compensation control signals $V_N$ and $V_{NS}$ to the actuator control signals $V_C$ and simulated actuator control signal $V_{CS}$.

PID controller 204 operates in a conventional fashion to generate a feedback control signal $V_{PID}$ based upon an input position error signal represented by $\theta_E$. The position error signal $\theta_E$ is output by summing junction 210 and represents a difference obtained by subtracting the actual position signal $\theta_A$ from the simulated position signal $\theta_{PTO}$ (i.e., $\theta_E=\theta_{PTO}-\theta_A$). PID controller 204 is tuned to generate a feedback control signal $V_{PID}$ that will reduce the difference between the simulated and actual position signals to zero when applied to plant 206 to drive the electric actuator in positioning the movable valve member (i.e., throttle plate 34).

The proximate time optimal controller 200 receives the previously described desired position signal $\theta_D$, and the simulated position and velocity signals $\theta_{PTO}$ and $\omega_{PTO}$. Based on these input signals, the proximate time optimal controller 200 generates a feedforward control signal designated as $V_{PTO}$. This feedforward control signal $V_{PTO}$ is provided as an input to summing junctions 212 and 214. A detailed description of the operation of proximate time optimal controller is provided below in the discussion associated with FIG. 7.

The feedback control signal $V_{PID}$, the compensation control signal $V_N$, and the feedforward control signal $V_{PTO}$ are combined by summing junction 212 to provide the actuator control signal $V_C$ that is applied to plant 206 to drive the electric actuator in positioning the movable valve member (i.e., electric motor 36 in positioning throttle plate 34).

Figure 5:
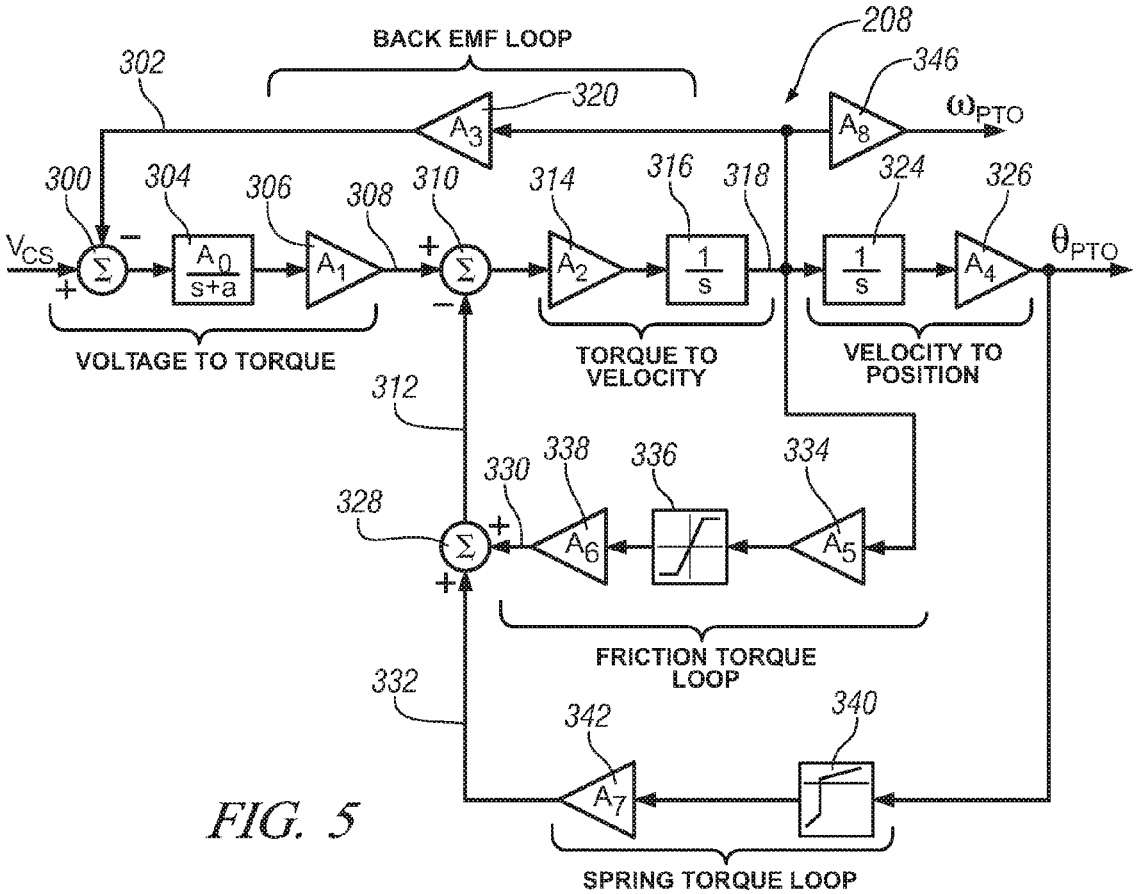
FIG. 5 is a function block diagram for the plant model employed to represent an electronic throttle valve in the exemplary embodiment of the invention illustrated in FIG. 4.

FIG. 5 shows a function block diagram for the plant model 208 depicted in FIG. 4. The plant model 208 provides a mathematical representation of the electromagnetic functions performed by the valve device and electric actuator. In the present exemplary embodiment of the invention, the plant model 28 is implemented to model the electronic throttle valve 18, and the electric motor 36 used in positioning throttle plate 34. As indicated previously, signal distortions associated with the circuitry of the motor driver 16 (see FIG. 1) are not significant and ignored in plant model 208. Modeling of electrically actuated valve devices, such as electronic throttle valve 18, is well know in the art and can be accomplished utilizing software such as MATLAB®, and other known modeling and simulation techniques.

To simplify the discussion, the block diagram of FIG. 5 has been labeled in accordance with the different functions and operations performed in the plant model 208. Square or rectangular blocks represent transfer functions. The triangular shaped blocks represent gain or scaling factors that multiply an input signal to provide a scaled output signal. It will be understood that the values for constants associated with the different scaling factors and transfer functions within the blocks are determined by the actual physical and electrical characteristics of the components of the electronic throttle valve 18 or other type devices being modeled.

For the exemplary embodiment, plant model 208 generates the simulated position signal $\theta_{PTO}$ and the simulated velocity signal $\omega_{PTO}$, which respectively represent the estimated position and estimated velocity of the throttle plate 34 that results when the simulated motor control signal $V_{CS}$ is applied to drive the electric motor 36 as mathematically represented by plant model 208. Accordingly, the simulated position signal $\theta_{PTO}$ and the simulated velocity signal $\omega_{PTO}$ respectively represent a estimated position and an estimated velocity for throttle plate 34 that would result from the simulated motor control signal $V_{CS}$ being applied to drive electric motor 36.

The first section of the plant model 208 shown in FIG. 5 represents a voltage to torque conversion effectuated by electric motor 36, and includes summing junction 300, transfer function 304, and scaling function 306. Summing junction 300 reduces the voltage associated with the applied simulated motor control signal $V_{CS}$ by the modeled motor back EMF voltage produced on arrowed line 302 in the back EMF loop. The output signal from summing junction 300 then represents the resulting voltage applied across the stator field windings of electric motor 36. The transfer function of block 304 converts this motor field winding voltage to an output signal corresponding the field winding current, where $A_0$=1/L and a=R/L, with R and L respectively representing the resistance and inductance of each of the stator field windings in electric motor 36. The field winding current signal output by block 304 is applied to scaling block 306, where it is multiplied by $A_1$, thereby providing a signal on arrowed line 308 that represents the electromagnetic torque developed by the electric motor 36. The scaling factor $A_1$=Kt, the motor torque constant.

The motor electromagnetic torque signal on arrowed line 308 is applied to summing junction 310, where it is reduce by a torque loss signal on arrowed line 312, thereby producing an output signal from summing junction 310 that represents the actual motor torque produced at the rotor of electric motor 36 in response to the applied simulated motor control signal $V_{CS}$. As described below, the torque loss signal on arrowed line 312 represents an approximation of torque opposing the movement of throttle plate 34 that is associated with frictional and spring biasing forces inherent in electronic throttle valve 18.

The next section of the plant model 208 converts the actual motor torque signal to velocity signal representing the simulated angular velocity of the rotor of electric motor 36 (in radians/second). This section of the model includes a scaling block 314 and an integrator block 316. The actual motor torque signal output by summing junction 310 is applied to scaling block 314, where it is multiplied by $A_2$, and then integrated by the integrator of block 316 to produce the simulated motor velocity signal on arrowed line 318. The scaling factor $A_2$=1/Jeq, where Jeq represents the total rotational inertia of components of electronic throttle valve 18 referenced to the shaft of the rotor of electric motor 36.

The signal representing the simulated motor velocity signal on arrowed line 318 is applied to scaling block 320 in the back EMF loop, where it is multiplied by $A_3$ to provide the motor back EMF voltage signal on arrowed line 302. The scaling factor $A_3$=Kv, where Kv is the back EMF voltage speed constant of electric motor 36.

The next section of the plant model 208 converts the motor velocity signal on arrowed line 318 to the output simulated position signal $\theta_{PTO}$ which represents an estimate of position of throttle plate 34 that would result from the simulated motor (actuator) control signal $V_{CS}$ being applied to drive electric motor 36. The simulated motor velocity signal on arrowed line 318 is integrated by block 324 and then multiplied by the scaling factor $A_4$ of block 326 to produce the output simulated position signal $\theta_{PTO}$ (in degrees). The scaling factor $A_4$=180/(n*π) is used to provide the proper conversion from radians to degrees, with n representing the gear ratio for gear mechanism 40 in the electronic throttle valve 18.

As shown, the plant model 208 provides the output simulated velocity signal $\omega_{PTO}$ (in degrees/second) by multiplying the motor velocity signal on arrowed line 318 by the scaling factor $A_8$ in scaling block 346 to provide the proper conversion from radians to degrees, and account for the gear ratio n of gear mechanism 40 ($A_8$=$A_4$=180/(n*π)).

As indicated above, the motor torque loss signal on line 312 represents the torque loss due to frictional forces associated with the movement of throttle plate 34 in electronic throttle valve 18, and the spring biasing forces associated throttle spring mechanism 40. As shown, the torque loss signal on arrowed line 312 is provided as an output by summing junction 328, which adds a frictional torque signal on arrowed line 330 with a spring biasing torque signal on arrowed line 332.

The frictional torque signal on arrowed line 330 is provided as the output of the friction torque loop, which includes lookup table 336 and scaling blocks 334 and 338. Scaling block 334 multiplies the motor rotational velocity signal on line 318 by the scaling factor $A_5$=180/π to convert the motor rotational velocity signal from radians/second to degrees/second. This converted motor velocity signal is then applied as the input to lookup table 336. Lookup table 336 is essentially a sgn function depending upon the value of the converted motor velocity signal that is typically used when approximating coulomb frictional force. The output from lookup table 336 is then multiplied by the scaling factor $A_6$ of block 338 to provide the final frictional torque signal on arrowed line 330. It will be recognized that the saturation values for the sgn function in lookup table 336, and the value of the scaling function $A_6$ are appropriately selected so the frictional torque signal will approximate the coulomb frictional torque that opposes the movement of throttle plate 34 and other components of electronic throttle valve 18 as referenced to the rotor shaft of electric motor 36.

The spring torque signal on arrowed line 332 is provided as the output of the spring torque loop, which includes lookup table 340 and scaling block 342. The simulated position signal $\theta_{PTO}$ is applied to lookup table 340. In the present embodiment, lookup table 340 contains a piecewise linear approximation for the spring biasing forces acting to oppose the movement of throttle plate 34 due to the throttle spring mechanism 40. The output of lookup table 336 is then multiplied by the scaling factor $A_7$ of block 342 to provide the spring biasing torque signal on arrowed line 332. The values in lookup table 340 and scaling factor $A_7$ are appropriately selected so that the spring biasing torque signal on arrowed line 332 approximates the spring torque loss due to the action of spring mechanism 40, which varies as a function of the simulated position signal $\theta_{PTO}$ for throttle plate 34.

Figure 6:
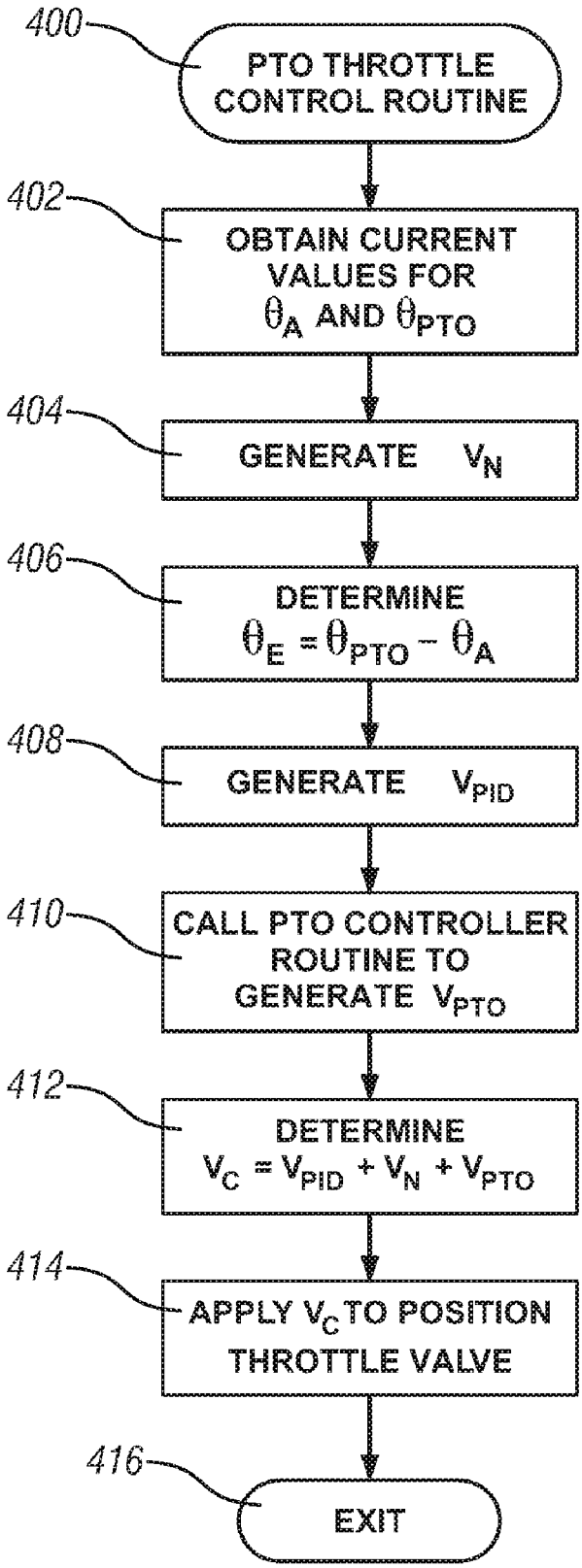
FIG. 6 is a flow diagram illustrating the operation of the embodiment of the invention shown in FIG. 4.
Figure 7:
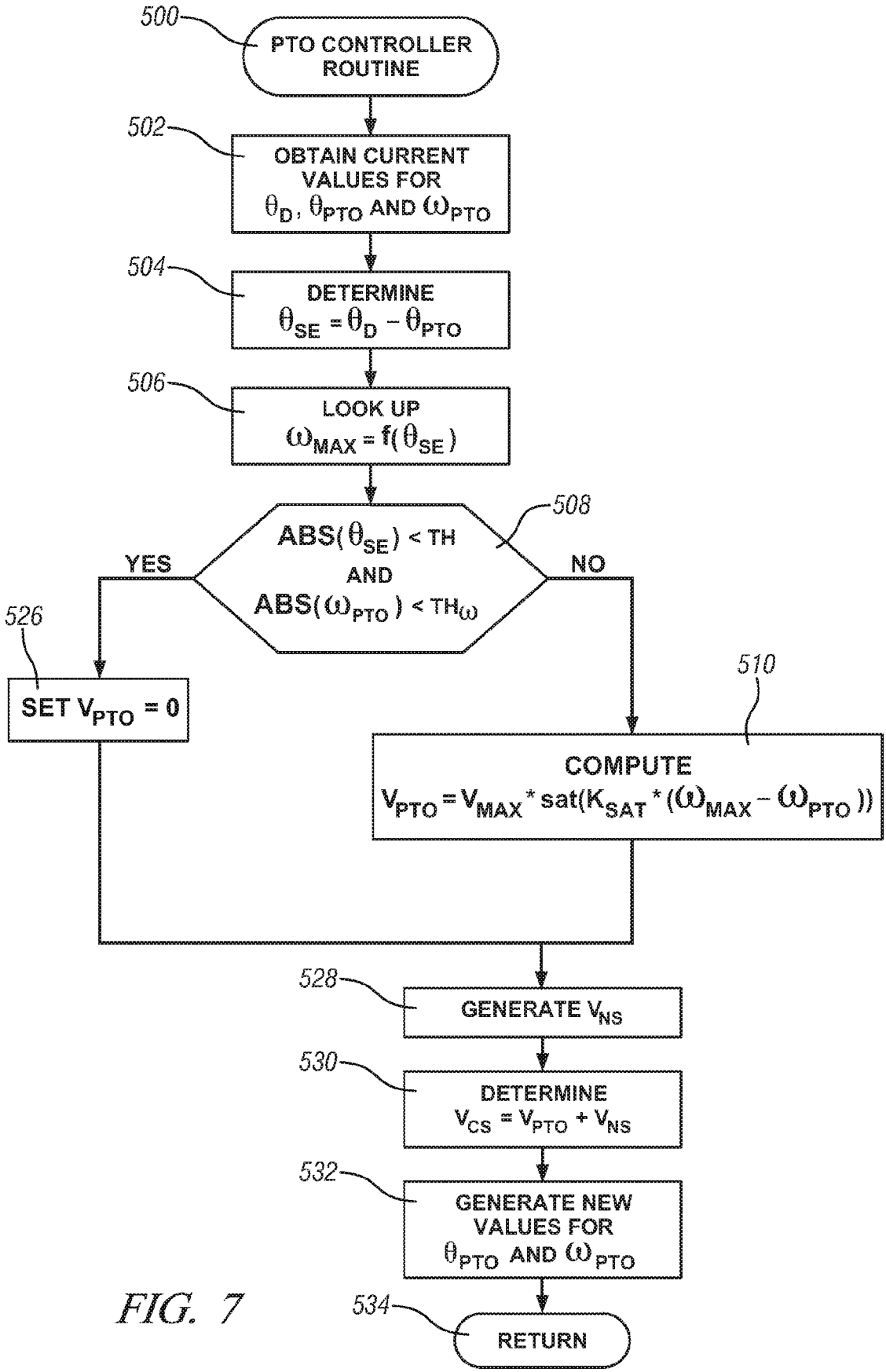
FIG. 7 shows a flow diagram illustrating the operation of the proximate time optimal controller used in the exemplary embodiment of the invention shown in FIG. 4.

It will be understood that control unit ECU 14 is configured to perform the control functions illustrated in the block diagram of FIG. 4 by way of a computer program stored in memory MEM. This computer program will now be described by way of exemplary program flow diagrams. FIG. 6 shows an exemplary flow diagram for the general operations carried out by ECU 14 in positioning the throttle plate 34 of electronic throttle valve 18 in accordance with the present invention. FIG. 7 shows an exemplary flow diagram detailing the steps carried out by the proximate time optimal controller 200 of FIG. 4. Programming of ECU 14 to carrying out the steps of the computer flow diagrams illustrated is well within the knowledge of those skilled in the art.

Referring now to FIG. 6, the proximate time optimal (PTO) throttle control routine is entered at step 400. This PTO throttle control routine is one of many different routines that are continuously executed by ECU 14 in a background engine control loop after engine startup and initialization of all engine control variables used in the engine control routines.

After entry at step 400, the routine proceeds to sep 402 where ECU 14 obtains current values for the actual position of throttle provided by the actual position signal $\theta_A$, and the simulated position of the throttle provided by the simulated position signal $\theta_{PTO}$. The current value for $\theta_A$ is obtained by sampling the output of the throttle position sensor 42 and storing this new value for $\theta_A$ in the memory MEM of CPU 14. The current value for $\theta_{PTO}$ is that value determined during the previous pass through the PTO controller routine 500 (see FIG. 7), which is called from step 410 in the present PTO throttle control routine 400.

The routine then proceeds to the next step 404, where a value for the compensation control signal $V_N$ is generated based upon the current value of the actual position signal $\theta_A$ stored in memory MEM. This is accomplished by carrying out computations corresponding to the functional blocks used in compensating for spring biasing torque in FIG. 2B, which are present the first nonlinear compensator 202 in the exemplary embodiment of the invention as shown in FIG. 4.

Next, the routine proceeds to step 406 where a present value for the position error signal $\theta_E$ is determined by subtracting the currently stored value for the actual position signal $\theta_A$ from the currently stored value for the simulated position signal $\theta_{PTO}$ (i.e., $\theta_E=\theta_{PTO}-\theta_A$).

From step 406, the routine proceeds to step 408, where a value for the feedback control signal $V_{PID}$ is generated based upon the present value of the position error signal $\theta_E$ determined above in step 406. This is accomplished by carrying out the known proportional, integral, and differential computations on the present value for $\theta_E$ (and values computed and stored during pervious passes through the routine) in accordance with operation of the conventional PID controller 204 shown in FIG. 4.

Next, the present routine proceeds to step 410, where the PTO controller routine 500 is called to generate a value for the feedforward control signal $V_{PTO}$ (the proximate time optimal control signal). A description of the steps carried out in the PTO controller routine 500 is provided below in the discussion related to FIG. 7.

After returning from the PTO controller routine 500 called at step 410, the present routine then proceeds to step 412, where a value for the motor (or actuator) control signal $V_C$ is generated by summing (combining) the values of the feedback control signal $V_{PID}$, the compensation control signal $V_N$, and the feedforward control signal $V_{PTO}$ that were respectively generated in the above steps 408, 404, and 410.

From step 412, the routine proceeds to the next step 414, where the value for the motor control signal $V_C$ is applied (as described previously) to drive electric motor 36 for positioning throttle plate 34.

At the completion of step 414, the routine proceeds to step 416, where the PTO throttle control routine 400 is exited for this particular pass through the background engine control loop.

Referring to FIG. 7, the steps carried out by the PTO controller routine called at step 410 in the above PTO throttle control routine will now be described.

The PTO controller routine is entered at step 500, and proceeds to step 502 where current values are obtained for the desired position signal $\theta_D$, the simulated position signal $\theta_{PTO}$, and the simulated velocity signal $\omega_{PTO}$. The current value for the desired position signal $\theta_D$ is typically obtained by sampling the output from the pedal position sensor 28, which is then stored the memory MEM of ECU 14. As indicated previously, the current value of $\theta_D$ may also be determined based upon sampling other inputs to ECU 14 provided by traction control, idle control, cruise control, and/or other engine control systems that may require modifications to the adjustment of the position of throttle plate 34. The current values for the simulated position signal $\theta_{PTO}$, and the simulated velocity signal $\omega_{PTO}$ are obtained from the previously stored values in the memory MEM of ECU 14 generated during the previous pass through the present routine 500 (see step 532 below).

From step 502, the present routine proceeds to step 504, where a current value for a simulated position error signal $\theta_{SE}$ is determined by subtracting the current value for the simulated position signal $\theta_{PTO}$ from the current value of the desired position signal $\theta_D$ (i.e., $\theta_{SE}=\theta_D-\theta_{PTO}$).

The routine then passes to step 506, where a current value for a maximum deceleration velocity $\omega_{MAX}$ of throttle plate 34 is determined based upon the current value of $\theta_{SE}$ computed at step 504. In the preferred embodiment, a lookup table is stored in memory MEM for determining values of $\omega_{MAX}$ corresponding to different values of $\theta_{SE}$. The functional relationship $\omega_{MAX}=f(\theta_{SE})$ used to obtain values for the lookup table is defined by the graph presented in FIG. 8, which will be discussed below.

After determining the current value for the maximum deceleration velocity $\omega_{MAX}$ at step 506, the routine proceeds to step 508 where a decision is made based upon the absolute values (ABS) of the simulated position error signal $\theta_{SE}$, and the simulated velocity signal $\omega_{PTO}$. If the magnitude of the difference between the values for the desired position $\theta_D$ and the simulated position $\theta_{PTO}$ is less than a predetermined threshold value TH (i.e., $ABS(\theta_{SE})<TH$), and the magnitude of the simulated velocity signal $\omega_{PTO}$ is less that a predetermined velocity threshold value $TH_\omega$ (i.e., $ABS(\omega_{PTO})<TH_\omega$), then the present routine 500 proceeds to step 526. Otherwise, the routine proceeds to step 510.

The threshold value TH may be a predetermined fixed value, or it could have different values depending upon the initial value of $\theta_{SE}$ when a change in desired position for throttle plate 34 is initiated. For example, if a change is made in the desired throttle position signal $\theta_D$ such that initially $ABS(\theta_{SE})$ is in the range from 0° to 10°, TH could be assigned to have a first predetermined value TH1. If $ABS(\theta_{SE})$ is initially in the range from say 10° to 40°, TH could be assigned to have a second predetermined value TH2, and likewise for $ABS(\theta_{SE})$ in other initial ranges of values. For the present embodiment of the invention, the predetermined threshold value TH was assigned a fixed value of 0.01 degrees, but it will be understood that this value can change depending upon the particular electronic throttle application. Similarly, the predetermined velocity threshold $TH_\omega$ can be assigned a value of 0.01 degrees/second, which may also vary depending upon the electronic throttle application.

As indicated above, if $ABS(\theta_{SE})<TH$ and $ABS(\omega_{PTO})<TH_\omega$ at step 508, the routine 500 proceeds to step 526, where the feedforward control signal $V_{PTO}$, which represents or is characterized by a voltage, is assigned to have a value of zero volts. It will be understood that steps 508 and 526 are implemented only to prevent the ECU 14 from reacting to small quantization and/or round off errors in the values of $\theta_{SE}$ and $\omega_{PTO}$ as these values approach zero. Steps 508 and 526 are not necessary when such errors are not considered significant, or ECU 14 has increased precision with regard to the sensing and computation functions being performed. After completing step 526, the routine proceeds to step 528.

At step 510, when either $ABS(\theta_{SE})\geqq TH$ or $ABS(\omega_{PTO})\geqq TH_\omega$, the routine proceeds to step 510, where the voltage of the feedforward control signal $V_{PTO}$ is determined or computed in accordance the equation:

$$V_{PTO}=V_{MAX}*\mathrm{sat}(K_{SAT}*(\omega_{MAX}-\omega_{PTO})),$$

where $V_{MAX}$ is a maximum predetermined voltage, $\mathrm{sat}(K_{SAT}*(\omega_{MAX}-\omega_{PTO}))$ is a saturation function having an argument $K_{SAT}*(\omega_{MAX}-\omega_{PTO})$, $K_{SAT}$ is a predetermined saturation gain value, $\omega_{MAX}$ is the maximum deceleration velocity, and $\omega_{PTO}$ is the estimated velocity of the movable valve member (throttle plate 34). Thus, the voltage characterizing the feedforward control signal is set to a predetermined maximum voltage represented by $V_{MAX}$, which is then adjusted in accordance with the defined saturation function $\mathrm{sat}(K_{SAT}*(\omega_{MAX}-\omega_{PTO}))$. Accordingly, the voltage of the feedforward control signal $V_{PTO}$ is set to: (i) the maximum predetermined voltage represented by $V_{MAX}$, when $K_{SAT}*(\omega_{MAX}-\omega_{PTO})>1$; (ii) a minimum predetermined voltage represented by $V_{MIN}=-V_{MAX}$, when $K_{SAT}*(\omega_{MAX}-\omega_{PTO})<-1$; and (iii) a value $K_{SAT}*(\omega_{MAX}-\omega_{PTO})$, when $-1<K_{SAT}*(\omega_{MAX}-\omega_{PTO})<1$. In the preferred embodiment, the saturation gain $K_{SAT}$ was given a value of 4.7763; however, this value will vary depending upon the particular electronic throttle being controlled. Although step 510 is depicted as a computation, it will be recognized that the voltage value assigned to $V_{PTO}$ can also be determined from a lookup table implementation. After the appropriate voltage value is assigned to the feedforward control signal at step 510, the routine then proceeds to step 528.

At step 528 a value for the simulated compensation control signal $V_{NS}$ is generated based upon the current value of the simulated throttle angular position signal $\theta_{PTO}$ stored in memory MEM. This is accomplished by carrying out computations corresponding to the functional blocks that are used to compensate for spring biasing torque in FIG. 2B, which are also present in the second nonlinear compensator 216 of FIG. 4.

Next, routine 500 proceeds to step 530, where a value for the simulated motor control signal $V_{CS}$ is determined by summing or combining the values of the simulated compensation control signal $V_{NS}$, and the feedforward control signal $V_{PTO}$ generated in the previous steps.

From step 530, the routine proceeds to step 532, where new values are generated for the simulated position signal $\theta_{PTO}$ and simulated velocity signal $\omega_{PTO}$. This is accomplished by applying the current value of the simulated motor control signal $V_{CS}$ determined at step 530 above to the plant model 208 in FIG. 4, and carrying out computations corresponding to the functional blocks provided in FIG. 5 representing the operation of the modeled electronic throttle valve 18. The new values for $\theta_{PTO}$ and $\omega_{PTO}$ that are generated as outputs from the modeled plant 208 are then stored in memory MEM for use during the next pass through the routines 400 and 500.

At the completion of step 532, routine 500 proceeds to step 534, where it returns the PTO throttle control routine.

Figure 8:
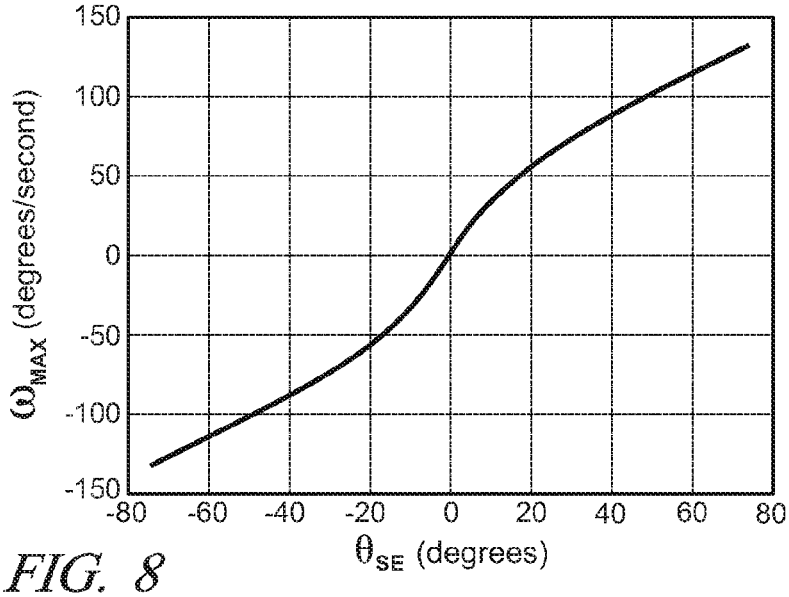
FIG. 8 is a graphical representation of a defined maximum deceleration velocity trajectory for the throttle plate, which varies as a function of the difference between the desired and estimated throttle plate positions.

FIG. 8 provides a graphical representation defining a functional relationship between the maximum deceleration velocity $\omega_{MAX}$ and the difference $\theta_{SE}$ between the desired and estimated positions for throttle plate 34. The values for $\omega_{MAX}$ approximately represent the maximum velocity that throttle plate 34 can be accelerated to achieve, for a given difference between the desired and estimated positions, before maximum deceleration must be applied to slow the velocity to zero as the actual position approaches the desired position, when the voltage of the motor control signal is switched between $V_{MAX}$ and $V_{MIN}=-V_{MAX}$ to achieve the maximum acceleration and deceleration of throttle plate 34. As the PTO controller 200 is a feedforward type controller, the estimated position $\omega_{PTO}$ for throttle plate 34 is used, rather than the actual position, when determining values for the maximum deceleration velocity $\omega_{MAX}$ for use in the PTO controller 200.

For the present embodiment of the invention, the functional relationship between $\omega_{MAX}$ and $\theta_{SE}$ shown in FIG. 8 was determined by first performing simulations using the plant model 208 representing the electronic throttle valve 18. In doing so, different initial velocities were assigned to $\omega_{PTO}$ to simulate the velocity of the throttle plate 34 in moving from a completely closed to completely open position (or vice versa). A motor control voltage of either $V_{MAX}$ or $V_{MIN}=-V_{MAX}$ was then applied to drive electric motor 36 (depending upon whether throttle plate 34 was opening or closing) to provide the maximum deceleration in slowing the velocity of throttle plate 34, while recording values for the simulated throttle position $\theta_{PTO}$ and the simulated velocity $\omega_{PTO}$. By repeating these simulations with different initial velocities assigned to $\omega_{PTO}$ values for $\omega_{MAX}$ were be found where the application of the motor control voltages of $V_{MAX}$ or $V_{MIN}$ caused the estimated velocity $\omega_{PTO}$ to approach zero as the estimated position of throttle plate 34 approached the desired position, i.e., when $\theta_{SE}=(\theta_D-\theta_{PTO})$ approached zero.

The curve representing actual values of $\omega_{MAX}$ as a function of $\theta_{SE}$ obtained as described above was found to have essentially an infinite slope as it passed through the origin of the coordinate system shown in FIG. 8. This was found to result in limit cycling when controlling the positioning of the throttle plate 34, To eliminate this limit cycling, the actual positive values of $\omega_{MAX}$ obtained above were reduced slightly, while the actual negative values of $\omega_{MAX}$ were slightly increased (approximately 17 degrees/second in both cases in the present embodiment). This resulted in a slight downward shifting of that portion of the actual curve representing $\theta_{MAX}$ for positive values of $\theta_{SE}$, and a slight upward shifting of that portion of the actual curve representing $\omega_{MAX}$ for negative values of $\theta_{SE}$. These shifted curves where then used to form the basis for the graphical representation of $\omega_{MAX}$ shown in FIG. 8, with values of $\omega_{MAX}$ near the origin adjusted to vary as a linear function of $\theta_{SE}$ in accordance with a line that passes through the origin and is tangent to both of the portions of the above described shifted curves. FIG. 8 shows this modification of the actual curve representing values of $\omega_{MAX}$, which was found to eliminate limit cycling in the control provided by the present invention. In what follows, the curve shown in FIG. 8 will be referred to as the defined maximum deceleration velocity trajectory that will be used to provide values for the maximum deceleration velocity $\omega_{MAX}$ for the present embodiment of the invention.

Although not advisable because damage could result, it will be recognized that the actual electronic throttle valve 18, rather than simulations, could be used when determining actual measured values for the maximum deceleration velocity $\omega_{MAX}$ used in obtaining the curve shown in FIG. 8.

The available maximum motor control voltage limits of $-V_B$ and $+V_B$ can not used to achieve the above described maximum acceleration and deceleration associated with $V_{MAX}$ and $V_{MIN}$ because use of these voltage limit in the actual control of the positioning of the throttle plate 34 would result in saturation of the motor control signal $V_C$. According, the predetermined maximum and minimum voltages $V_{MAX}$, and $V_{MIN}=-V_{MAX}$ are selected to provide enhanced acceleration and deceleration in the control of positioning throttle plate 34, without causing saturation of the motor control signal $V_C$.

It will be understood from the above description that PTO controller 200 operates as a feedforward controller in providing the feedforward control signal $V_{PTO}$ as a component for the motor control signal $V_C$. Instead of using the actual values for the position and velocity of throttle plate 34, the PTO controller 200 uses the estimated position signal $\theta_{PTO}$, and estimated velocity signal $\omega_{PTO}$ in generating the feedforward control signal $V_{PTO}$. Accordingly, the PTO controller 200 operates in a completely feedforward fashion without the use any feedback of any information regarding the actual position or velocity of throttle plate 34.

It will also be understood that PTO controller 200 functions as a modified bang-bang type controller by setting the voltage of feedforward control signal $V_{PTO}$ to a predetermined maximum voltage $V_{MAX}$, which is adjusted or multiplied the saturation function $\mathrm{sat}(K_{SAT}*(\omega_{MAX}-\omega_{PTO}))$.

When the magnitude of the differenced between the simulated throttle velocity $\omega_{PTO}$ and the maximum deceleration velocity $\omega_{MAX}$ is significantly large such that $K_{SAT}*(\omega_{MAX}-\omega_{PTO})>1$ or $K_{SAT}*(\omega_{MAX}-\omega_{PTO})<-1$), the voltage of the feedforward control signal $V_{PTO}$ is respective set to a value of $V_{MAX}$ or $V_{MIN}=-V_{MAX}$. In switching the voltage of $V_{PTO}$ between these predetermined maximum and minimum voltages, the PTO controller 200 functions as a bang-bang type controller. However, when the magnitude of the difference between the simulated throttle velocity $\omega_{PTO}$ and the maximum deceleration velocity $\omega_{MAX}$ is less significant such that $-1<(K_{SAT}*(\omega_{MAX}-\omega_{PTO}))<1$, the feedforward control signal $V_{PTO}$ is adjusted or modified to have a voltage equal to $V_{MAX}*K_{SAT}*(\omega_{MAX}-\omega_{PTO})$, which falls in between the predetermined maximum and minimum voltages $V_{MAX}$ and $V_{MIN}$. As a result of this adjustment, the PTO controller 200 provides for a modified band-bang type control.

In adjusting the voltage of $V_{PTO}$ in the above described fashion, throttle plate 34 is accelerated and decelerated so as to cause the estimated velocity $\omega_{PTO}$ to approximately follow the maximum deceleration velocity trajectory defined by the values of $\omega_{MAX}$ (the curve presented in FIG. 8) as the estimated position for throttle plate 34 moves to the desired position.

Figure 9A:
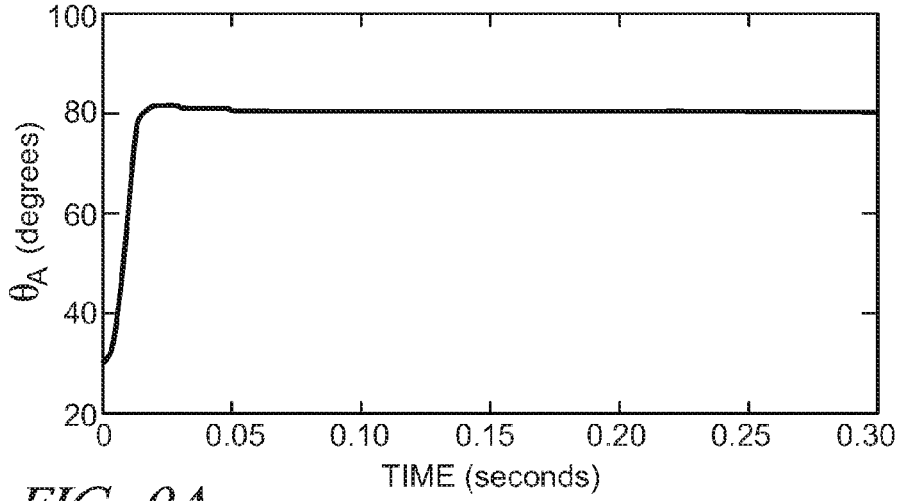
FIG. 9A-9B respectively show simulated graphical representations of the throttle valve response and motor control signal that result from a step change in desired throttle plate position for the embodiment of the invention shown in FIG. 4.
Figure 9B:
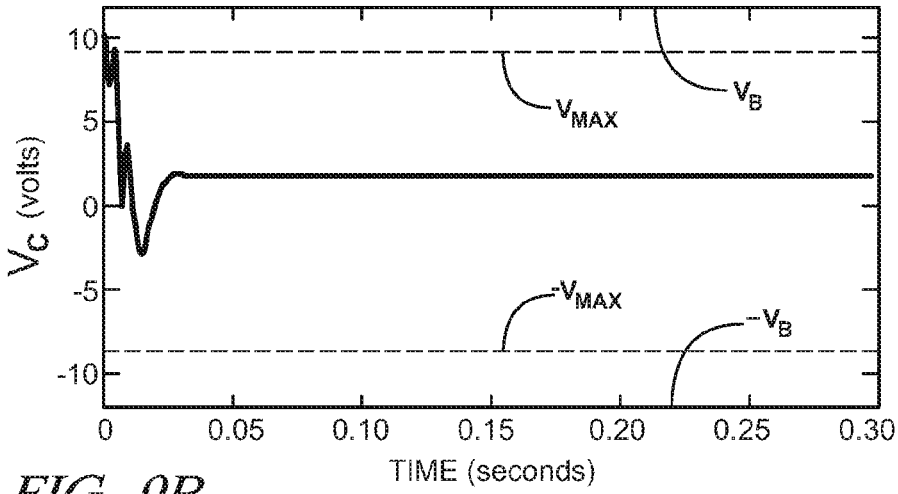

FIGS. 9A and 9B respectively show simulated graphical representations of the throttle valve response in terms of $\theta_A$, and the motor control signal $V_C$ resulting from a step function increase in the desired throttle position $\theta_D$ for the exemplary embodiment of the invention depicted in FIG. 4. The throttle response of FIG. 9A is shown as the change in the actual angular position $\theta_A$ of throttle plate 34 as a function of time for a step function increase in the desired opening of throttle plate 34 from $\theta_D=30°$ to $\theta_D=80°$ that occurs at time=0 seconds. The corresponding motor control signal $V_C$ is shown in FIG. 9B as a function of time for the same step increase in the desired throttle position $\theta_D$.

It will be recognized from FIG. 9A that the rise time for throttle plate 34 to reach the desired 80 degree open position is approximately 12.3 milliseconds when responding to the above described step increase in the desired position for throttle plate 34. Thus, the rise time of the throttle for the present invention is significantly reduced when compared to the 60.6 millisecond rise time for the throttle response of the prior art electronic throttle control system of FIG. 2A for the same step increase in the desired throttle position.

This reduction in the rise time of the throttle response results from the use of significantly more of the available maximum motor control voltage ($-V_B$ to $+V_B$) in controlling the positioning of throttle plate 34. In the present embodiment, the maximum and minimum values for the feedforward control signal $V_{PTO}$ were respectively set to $V_{MAX}=+9$ volts and $V_{MIN}=-9$ volts as indicated in FIG. 9B.

Immediately after the step increase in the desired throttle position signal $\theta_D$ described above, the proximate time optimal controller 200 sets $V_{PTO}$ to $V_{MAX}=+9$ volts to rapidly accelerate the movement of throttle plate 34 toward the desired position. PTO controller 200 then adjusts the voltage of the feedforward control signal $V_{PTO}$ as described above to control the estimated velocity $\omega_{PTO}$ of the throttle plate 34 to approach and approximately track or follow the maximum deceleration velocity trajectory defined by values $\omega_{MAX}$ in FIG. 8, as the simulated position $\theta_{PTO}$ of throttle plate 34 is controlled to approach the desired position $\theta_D$. This contributes to the significant increase in amplitude the motor control signal $V_C$ occurring immediately after time=zero in FIG. 9B, since $V_{PTO}$ is one of the components of $V_C$.

When the magnitudes of the error between the desired and simulated positions $\theta_{SE}$, and the simulated velocity $\omega_{PTO}$ are both sufficiently small, the voltage of the feedforward control signal $V_{PTO}$ is set to zero (switched off). The amplitude of the motor control signal $V_C$ is then determined solely by the compensation control signal $V_N$ and the PID control signal $V_{PID}$, which are then used to complete the control of the movement of the actual position $\theta_A$ of throttle plate 34 to the estimated position $\theta_{PTO}$.

It will be recognized from FIG. 9B that once the feedforward control signal $V_{PTO}$ is set to a zero value, the amplitude of the motor control signal $V_C$ approaches approximately 2.0 volts providing the necessary offset voltage to electric motor 36 to maintain the spring biased throttle plate 34 at the desired open position of $\theta_D=80$ degrees.

It will also be recognized that the magnitude of the voltages selected for $V_{MAX}$ and $V_{MIN}=-V_{MAX}$ determine the rate at which the throttle plate 34 is accelerated and decelerated toward the desired throttle position $\theta_D$. The larger the magnitude of these values, the more enhanced the acceleration and deceleration the throttle plate 34 will be in moving toward the desired throttle position $\theta_D$. However, the magnitude of $V_{MAX}$ and $V_{MIN}$ can not be selected to be so large as to cause the motor control voltage to saturate at the maximum and minimum motor control voltage limits (i.e., $+V_B=12$ volts, and $-V_B=-12$ volts) shown in FIG. 9B. Accordingly, the magnitude of the values of $V_{MAX}$ and $V_{MIN}$ can be selected to be as large as practical, without causing the voltage of the motor control signal $V_C$ to exceed the motor control voltage limits of $+V_B$ and $-V_B$.

In the present embodiment, the maximum contribution of $V_N$ and $V_{PID}$ to the motor control signal $V_C$ was estimated to be from about +3.0 volts to −3.0 volts. Accordingly, $V_{MAX}$ and $V_{MIN}$ were respectively selected to be approximately +9 volts and −9 volts to avoid possible saturation of the motor control voltage $V_C$. It will be recognized that the relative contributions of the different control signal components of $V_C$ can be determined either by simulation or experimental measurements made while commanding throttle plate 34 to move to different positions.

From the foregoing, it will be understood that the proximate time optimal controller 200 is specifically designed to use a substantial portion of the maximum available voltage established by the motor control voltage limits to enhance acceleration and deceleration in the positioning the throttle plate 34, without causing saturation of the motor control voltage $V_C$. Sufficient voltage must be reserved for the operation of the PID controller 204 and the nonlinear compensator 202.

It has also been found that with the present invention, the PID controller 204 can be designed to be more aggressive than traditional PID controllers since the position error signal $\theta_E=\theta_{PTO}-\theta_A$ used in the present invention tends to smaller that the throttle position error signal $*\theta_E=\theta_D-\theta_A$ typically used by traditional PID controllers.

From the foregoing, it will be understood that the present invention can be applied to achieve significant improvement in the response time of valve devices such as electronic throttle valves having movable valve members positioned by electric actuators. It will also be understood that the improved response time could be traded-off for less expensive, lower torque producing, and low power consuming actuators.

While the invention has been described by reference to certain preferred embodiments and implementations, it will be understood that numerous changes could be made within the spirit and scope of the described inventive concepts. For example, the present invention may be utilized to control valve devices having linearly actuated as well as rotationally actuated movable valve members. In will also be understood that the present invention can be adapted to control the positioning of other types of movable members positioned by electrical actuators, such as EGR valves and the like. Accordingly, it is intended that the invention not be limited to the disclosed embodiments, but that it have the full scope permitted by the language of the following claims.

The invention claimed is:

1. A system for controlling a throttle valve, the throttle valve having a throttle plate positioned by an electric motor for opening and closing the throttle valve, the system comprising:

an accelerator pedal position sensor providing a desired position signal indicative of a desired position for the throttle plate;

a throttle valve position sensor providing an actual position signal indicative an actual position for the throttle plate;

a control unit receiving the actual and desired position signals and programmed to:

(a) generate a simulated position signal and a simulated velocity signal based upon a simulated motor control signal, the simulated position and simulated velocity signals respectively representing an estimated position and estimated velocity for the throttle plate that would result from the simulated motor control signal being applied to drive the electric motor;

(b) generate a feedforward control signal based upon the desired position signal, the simulated position signal, and the simulated velocity signal, wherein the simulated motor control signal comprises the feedforward control signal;

(c) generate a feedback control signal based on a difference between the simulated and actual position signals for the throttle plate;

(d) combine the feedforward control signal and the feedback control signal to produce a motor control signal; and (e) apply the motor control signal to drive the electric motor, whereby the throttle plate is controlled to move from the actual position to the desired position.

2. The system of claim 1, wherein the control unit is further configured to provide a mathematical model representing electromechanical functions performed by the throttle valve and the electric motor, and the simulated position and simulated velocity signals for the throttle plate are generated by applying the simulated motor control signal to drive the electric motor as represented by the mathematical model.

3. The system of claim 1, wherein the control unit is further programmed to:

(f) generate a compensation control signal base upon the actual position signal;

(g) generate a simulated compensation control signal based upon the simulated position signal;

(h) combine the compensation control signal with the feedback and feedforward control signals when producing the motor control signal;

(i) combine the simulated compensation control signal and the feedforward control signal to produce the simulated motor control signal; and whereby the motor control signal and the simulated motor control signal are compensated to offset torque opposing movement of the throttle plate by the electric motor.

4. The system of claim 1, wherein the feedforward control signal is characterized by a voltage that is adjusted to cause the estimated velocity of the throttle plate to approximately follow a defined maximum deceleration velocity trajectory as the estimated position of the throttle plate moves to the desired position.

5. A method for controlling a valve device having a movable valve member positioned by an electric actuator for opening and closing the valve device, the steps of the method comprising:

obtaining a desired position signal indicative of a desired position for the movable valve member;

obtaining an actual position signal indicative an actual position of the movable valve member;

generating a feedforward control signal based upon the desired position signal, a simulated position signal and a simulated velocity signal, wherein the simulated position and simulated velocity signals respectively represent an estimated position and estimated velocity of the movable valve member that would result from a simulated actuator control signal comprising the feedforward control signal being applied to drive the electric actuator;

generating a feedback control signal based on a difference between the simulated position signal and actual position signal for the movable valve member;

combining the feedforward control signal and the feedback control signal to produce an actuator control signal; and applying the actuator control signal to drive the electric actuator, whereby the movable valve member is controlled to move from the actual position to the desired position.

6. The method of claim 1, wherein the simulated position and simulated velocity signals are generated by applying the simulated actuator control signal to a plant model, wherein the plant model provides a mathematical representation of electromechanical functions performed by the valve device and the electric actuator in responding to the simulated actuator control signal.

7. The method of claim 1, further including the steps of:

generating a compensation control signal base upon the actual position signal;

generating a simulated compensation control signal based upon the simulated position signal;

combining the compensation control signal with the feedback and feedforward control signals to produce the actuator control signal;

combining the simulated compensation control signal with the feedforward control signal to produce the simulated actuator control signal; and whereby the actuator control signal and the simulated actuator control signal are compensated to offset torque opposing movement of the movable valve member by the electric actuator.

8. The method of claim 1, wherein the feedforward control signal is characterized by a voltage that is adjusted to cause the estimated velocity of the movable valve member to approximately follow a defined maximum deceleration velocity trajectory as the estimated position moves to the desired position.

9. The method of claim 1, wherein the feedforward control signal is characterized by a voltage, and the step of generating the feedforward control signal further includes the steps of:

determining a difference between the desired and estimated positions for the movable valve member; and setting the voltage characterizing the feedforward control signal to a value of zero, when the difference between the desired and estimated positions of the movable valve member has a magnitude less than a predetermined threshold value and the estimated velocity of the movable value member has a magnitude less that a predetermined velocity threshold value, otherwise, setting the voltage characterizing the feedforward control signal to a value determined in accordance with the equation:

$$V_{MAX}*\mathrm{sat}(K_{SAT}*(\omega_{MAX}-\omega_{PTO})),$$

where $V_{MAX}$ is a maximum predetermined voltage, $\mathrm{sat}(K_{SAT}*(\omega_{MAX}-\omega_{PTO}))$ is a saturation function having an argument $K_{SAT}*(\omega_{MAX}-\omega_{PTO})$, $K_{SAT}$ is a predetermined saturation gain value, ωMAX is a maximum deceleration velocity, and $\omega_{PTO}$ is the estimated velocity of the movable valve member.

10. The method of claim 9, wherein the maximum deceleration velocity $\omega_{MAX}$ varies as a function of the difference between the desired and estimated positions of the movable valve member, thereby defining a maximum deceleration velocity trajectory along which the estimated velocity of the movable valve member is controlled to approximately follow, as the difference between the desired and estimated positions of the movable valve member is reduced to zero 11. The method of claim 1, wherein the feedforward control signal is characterized by a voltage that is set to: (i) a maximum predetermined voltage represented by $V_{MAX}$, when $K_{SAT}*(\omega_{MAX}-\omega_{PTO})>1$, (ii) a minimum predetermined voltage represented by $V_{MIN}=-V_{MAX}$, when $K_{SAT}*(\omega_{MAX}-\omega_{PTO})<-1$, and (iii) a voltage equal to $K_{SAT}*(\omega_{MAX}-\omega_{PTO})$, when $-1<K_{SAT}*(\omega_{MAX}-\omega_{PTO})<1$, where $V_{MAX}$ is a maximum predetermined voltage, $\mathrm{sat}(K_{SAT}*(\omega_{MAX}-\omega_{PTO}))$ is a saturation function having an argument $K_{SAT}*(\omega_{MAX}-\omega_{PTO})$, $K_{SAT}$ is a predetermined saturation gain value, $\omega_{MAX}$ is a maximum deceleration velocity, and $\omega_{PTO}$ is the estimated velocity of the movable valve member, whereby the movable valve member is selectively accelerated and decelerated from the actual position to the desired position.

12. The method of claim 11, wherein the actuator control signal is characterized by a voltage bounded by defined maximum and minimum motor control voltage limits to avoid saturation of the actuator control signal, and the predetermined maximum and minimum voltages of the feedforward control signal are selected to provide enhanced acceleration and deceleration of the movable valve member without causing saturation of the actuator control signal when controlling the valve device.

13. A method for controlling a throttle valve having a throttle plate positioned by an electric motor for opening and closing the throttle valve, the steps of the method comprising:

obtaining a desired position signal from an accelerator pedal sensor, the desired position being indicative of a desired position for the throttle plate;

obtaining an actual position signal from a throttle valve position sensor, the actual position signal being indicative an actual position for the throttle plate;

configuring a control unit to receive the desired position and actual position signals and perform the steps of:

(a) generating a simulated position signal and a simulated velocity signal based upon a simulated motor control signal, the simulated position and simulated velocity signals respectively representing an estimated position and estimated velocity for the throttle plate that would result from the simulated motor control signal being applied to drive the electric motor;

(b) generating a feedforward control signal based upon the desired position signal, the simulated position signal, and the simulated velocity signal, wherein the simulated motor control signal comprises the feedforward control signal;

(c) generating a feedback control signal based on a difference between the simulated position signal and actual position signal for the throttle plate;

(d) combining the feedforward control signal and the feedback control signal to produce a motor control signal; and (e) applying the motor control signal to drive the electric motor, whereby the throttle plate is controlled to move from the actual position to the desired position.

14. The method of claim 13, wherein the control unit is further configured to provide a mathematical model representing electromechanical functions performed by the throttle valve and the electric motor, and the simulated position and simulated velocity signals for the throttle plate are generated by applying the simulated motor control signal to drive the electric motor as represented by the mathematical model.

15. The method of claim 13, wherein the control unit is further configured to perform the steps of:

(f) generating a compensation control signal base upon the actual position signal;

(g) generating a simulated compensation control signal based upon the simulated position signal;

(h) combining the compensation control signal with the feedback and feedforward control signals when producing the motor control signal;

(i) combining the simulated compensation control signal with the feedforward control signal to produce the simulated motor control signal;

whereby the motor control signal and the simulated motor control signal are compensated to offset torque opposing movement of the throttle plate by the electric motor.

16. The method of claim 15, wherein the throttle valve includes a spring mechanism, and the opposing torque comprises spring biasing torque produced by the spring mechanism.

17. The method of claim 13, wherein the feedforward control signal is characterized by a voltage that is adjusted to cause the estimated velocity of the throttle plate to approximately follow a defined maximum deceleration velocity trajectory as the estimated position of the throttle plate is moved to the desired position.

18. The method of claim 13, wherein the feedforward control signal is characterized by a voltage, and the step of generating the feedforward control signal further includes the steps of:

determining a difference between the desired and estimated positions for the throttle plate; and setting the voltage of the feedforward control signal to zero when the difference between the desired and estimated positions of throttle plate has an absolute value less than a predetermined threshold value and the estimated velocity of the throttle plate has an absolute value less that a predetermined velocity threshold value, otherwise, setting the voltage characterizing the feedforward control signal to a value determined in accordance with the equation:

$$V_{MAX}*\mathrm{sat}(K_{SAT}*(\omega_{MAX}-\omega_{PTO})),$$

where $V_{MAX}$ is a maximum predetermined voltage, $\mathrm{sat}(K_{SAT}*(\omega_{MAX}-\omega_{PTO}))$ is a saturation function having an argument $K_{SAT}*(\omega_{MAX}-\omega_{PTO})$, $K_{SAT}$ is a predetermined saturation gain value, $\omega_{MAX}$ is a maximum deceleration velocity, and $\omega_{PTO}$ is the estimated velocity of the movable valve member.

19. The method of claim 13, wherein the feedforward control signal is characterized by a voltage, and the step of generating the feedforward control signal further includes the step of setting the voltage characterizing the feedforward control signal to a predetermined maximum voltage, which is adjusted in accordance with a defined saturation function that varies based upon the difference between the desired and estimated positions of the throttle plate and the simulated velocity signal, thereby selectively accelerating and decelerating movement of the throttle plate from the actual position to the desired position.

20. The method of claim 19, wherein:

the voltage of the feedforward control signal is set equal to $V_{MAX}*\ \mathrm{sat}(K_{SAT}*(\omega_{MAX}-\omega_{PTO}))$, where $V_{MAX}$ is the predetermined maximum voltage, sat represents a defined saturation function, $K_{SAT}$ is a predetermined saturation gain value, $\omega_{MAX}$ is a maximum deceleration velocity determined based upon the difference between the desired and estimated positions of the throttle plate, and $\omega_{PTO}$ is the estimated velocity of the throttle plate.

21. The method of claim 19, wherein the motor control signal is characterized by a voltage that is bounded by defined maximum and minimum motor control voltage limits to avoid saturation of the motor control signal, and the predetermined maximum voltage is selected to provide enhanced acceleration and deceleration of the throttle plate without causing saturation of the motor control signal when controlling the throttle valve.

* * * * *